United States Patent [19]

Herley

[11] Patent Number: 4,996,565

[45] Date of Patent: Feb. 26, 1991

[54] DEVELOPER MATERIAL MIXING APPARATUS

[75] Inventor: James A. Herley, Henrietta, N.Y.

[73] Assignee: Xerox Corporation, Stamford, Conn.

[21] Appl. No.: 373,129

[22] Filed: Jun. 29, 1989

[51] Int. Cl.[5] ..... G03G 15/06

[52] U.S. Cl. ..... 355/245; 118/657; 355/253

[58] Field of Search ..... 355/245, 250, 251, 253, 355/259, 261; 118/653, 656, 657, 658, 661, 651

[56] References Cited

U.S. PATENT DOCUMENTS

| | | | |
|---|---|---|---|
| 3,697,050 | 10/1972 | Stanley | 118/658 |
| 3,943,887 | 3/1976 | Smith | 118/657 |
| 3,947,107 | 3/1976 | Smith | 355/245 |
| 4,162,842 | 7/1979 | Wu | 355/251 X |
| 4,498,755 | 2/1985 | Ohkubo et al. | 118/658 X |
| 4,577,587 | 3/1986 | Kamezaki | 118/658 |
| 4,864,349 | 9/1989 | Ito | 118/653 X |

FOREIGN PATENT DOCUMENTS

| | | | |
|---|---|---|---|
| 0122064 | 9/1981 | Japan | 355/245 |
| 0018374 | 1/1988 | Japan | 355/253 |
| 0021472 | 1/1989 | Japan | 355/245 |

*Primary Examiner*—A. T. Grimley
*Assistant Examiner*—Robert Beatty
*Attorney, Agent, or Firm*—H. Fleischer; J. E. Beck; R. Zibelli

[57] ABSTRACT

An apparatus which mixes developer material in the chamber of a developer housing. A pair of augers transport the developer material in a recirculating path from one region of the chamber to another region. A generally planar member is interposed between the augers to separate the augers from one another. The planar member has an aperture in at least one marginal region configured to allow developer material to gently move between the first auger and the second auger and being adapted to reduce back up of the developer material and flow unevenness.

4 Claims, 3 Drawing Sheets

DEVELOPER MATERIAL MIXING APPARATUS

This invention relates generally to an electrophotographic printing machine, and more particularly concerns an apparatus for mixing developer material used in the development system of the printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer material comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

A high speed commercial printing machine of this type uses a magnetic brush development system for developing the latent image. The magnetic brush system generally employs several developer rollers for transporting the developer material closely adjacent to the photoconductive surface. Augers are usually used to mix and disperse the developer material throughout the developer housing. During development, the toner particles are attracted from the carrier granules to the latent image. Thus, toner particles are depleted from the developer material during usage. It therefore becomes necessary to furnish additional toner particles to the system in order to maintain the concentration substantially constant. As the tone particles are depleted from the developer material, new toner particles are added thereto. However, the new toner particles frequently remain segregated from the carrier granules. In addition, the developer material in the chamber of the developer housing may have areas of high and low toner concentration. This may result in uneven development or areas of high background. It is, therefore, necessary to mix the toner particles with the carrier granules in order to maintain the desired triboelectric characteristics and to insure that the concentration of the toner particles throughout the developer material is substantially uniform. Present development systems utilize augers for developer material movement. These systems use a multiple auger system, which transport replenished material for the length of the development zone and then assist in cross over to the second auger which transports developer material in the opposite direction. The material consistency changes due to the development process and therefore requires separation of the auger troughs or sumps by a baffle. At the point where the developer material crosses over, the material leaves the longitudinal influence of the auger face and is directed laterally into the other auger sump. Due to the material direction change, the material forms a hump in the sump until it spreads out sufficiently to be influenced longitudinally by the other auger. The process of forming a hump is known as pumping. Developer material begins to back up until it is out of the influence of the transport device. This material becomes relatively stagnant and may cause unevenness of developer material. This degrades the quality of the image developed on the photoconductive member. Various techniques have been devised for mixing of developer material. This includes other passive and active approaches. In a passive approach, different types of baffles are employed for controlling the direction of flow of the toner particles and carrier granules so as to optimize mixing therebetween. In an active system, the mixing device moves so as to mix the carrier granules and toner particles with one another. The following disclosures appear to be relevant:

U.S.-A-3,697,050;
Patentee: Stanley;
Issued: Oct. 10, 1972.
U.S.-A-3,943,887;
Patentee: Smith;
Issued: May 16, 1976.
U.S.-A-3,947,107;
Patentee: Smith;
Issued: Apr. 22, 1986.
U.S.-A-4,577,587;
Patentee: Kamezaki;
Issued: Mar. 25, 1986.

The relevant portions of the foregoing disclosures may be briefly summarized as follows:

U.S.-A-3,697,050 discloses a cross-mixing baffle plate having a plurality of openings or chutes which mix fresh toner particle with developer material returning from the developer rollers as it descends into the sump of the developer housing.

U.S.-A-3,943,887 describes a hybrid cross mixer having an auger and a set of baffles. The auger advances the developer material and new toner particles across the top of the V-shaped baffles. The developer material and new toner flow toward the center of the baffle plate and are mixed enroute to the sump of the developer housing.

U.S.-A-3,947,107 discloses a pair of rotatably driven augers and a baffle. The augers rotate in opposite directions and mix developer material with new toner. The mixed material is discharged through apertures in the baffle into the sump in the developer housing.

U.S.-A-4,577,587 describes a scraping roller for removing developer which moves along a guiding mechanism onto a stirring roller which mixes new toner with the scraped developer material. The scraping roller may be a spiral to effect scraping and stirring simultaneously. The stirring roller has vanes with gradually deviating notch to create delivery spaces through which transportation and mixing of the developer material is achieved.

In accordance with one aspect of the present invention, there is provided an apparatus for mixing developer material, including a housing defining a chamber storing a supply of developer material therein. First means transport the developer material in a first direction from one region of the chamber of the housing to another region thereof. Second means is provided for transporting the developer material in a second direction opposed to the first direction. Means separate the first means from the second means. The separating means has an aperture in at least one portion thereof configured to allow developer material to gently move between the first means and the second means. The aperture is adapted to reduce back up of developer material and flow unevenness.

Pursuant to another aspect of the present invention, there is provided an electrophotographic printing machine of the type in which an electrostatic latent image recorded on a photoconductive member is developed with a developer material. This includes a housing defining a chamber storing a supply of developer material therein. First means transport the developer material in a first direction from one region of the chamber of the housing to another region thereof. Second means are provided for transporting the developer material in a second direction opposed to the first direction. Means, disposed, at least partially in the chamber of the housing, develop the electrostatic latent image recorded on the photoconductive member with developer material. The developing means receives developer material from the first means and the second means. Means separate the first means from the second means. The separating means has an aperture in at least one portion thereof configured to allow developer material to gently move between the first means and the second means. The aperture is adapted to reduce back up of developer material and flow unevenness.

Still a further aspect of the present invention is an apparatus for developing a latent image recorded on a member with developer material comprising at least carrier granules and toner particles. The apparatus includes a housing defining a chamber storing a supply of developer material therein. Means, disposed, at least partially in the chamber of the housing, advance developer material closely adjacent to the latent image so that the latent image attracts toner particles thereto forming a toner powder image on the member. A first auger, disposed at least partially in the developer material in the chamber of the housing, transports the developer material in a first direction from one region of the chamber of the housing to another region thereof. A second auger, disposed at least partially in the developer material in the chamber of the housing, transports the developer material in a second direction opposed to the first direction. Means separates the first auger from the second auger. The separating means has an aperture in at least one portion thereof configured to allow developer material to gently move between the first auger and the second auger. The aperture is adapted to reduce back up of developer material and flow unevenness.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
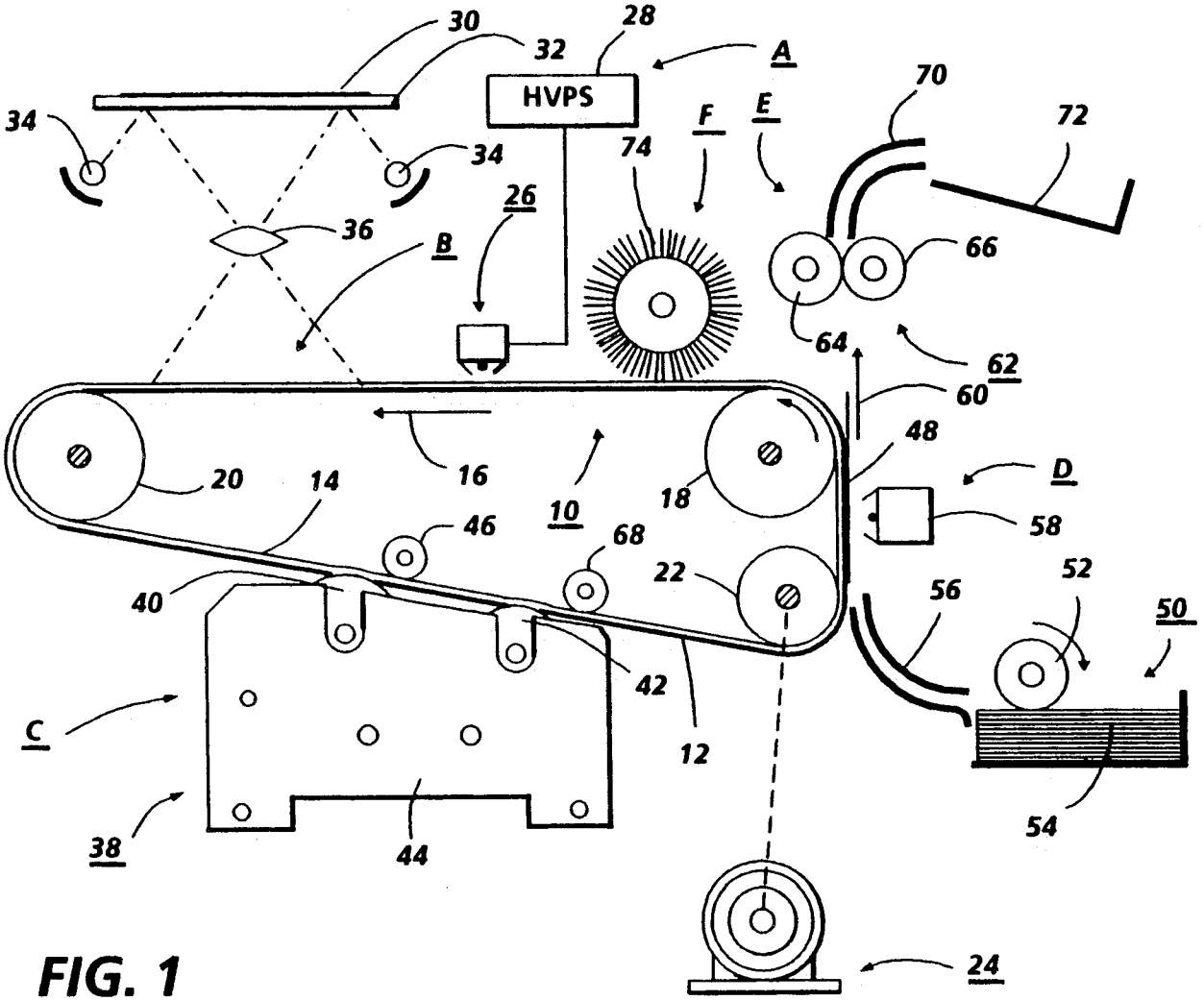
FIG. 1 is a schematic elevational view of an illustrative electrophotographic printing machine incorporating a mixing apparatus having the features of the present invention therein.

Referring initially to FIG. 1, there is shown an illustrative electrophotographic printing machine incorporating the mixing apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller, 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated generally by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. Developer rollers 40 and 42 are mounted, at least partially, in the chamber of developer housing 44. The chamber in developer housing 44 stores a supply of developer material therein. A toner container dispenses additional toner particles into the developer material in the chamber of the developer housing as toner particles are depleted therefrom due to the development of the latent image. These fresh toner particles are mixed with the developer material in the chamber of the developer housing. Mixing of the developer material and fresh toner particles is achieved by the mixing apparatus of the present invention which will be described hereinafter in greater detail with reference to FIGS. 2 through 4, inclusive. Guide rollers 46 and 68 deflect belt 10 so that a portion of belt 10 is wrapped about a region of the exterior circumferential surface of rollers 40 and 42 to form extended development zones about each of the developer rollers.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 58. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom a t cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

Figure 2:
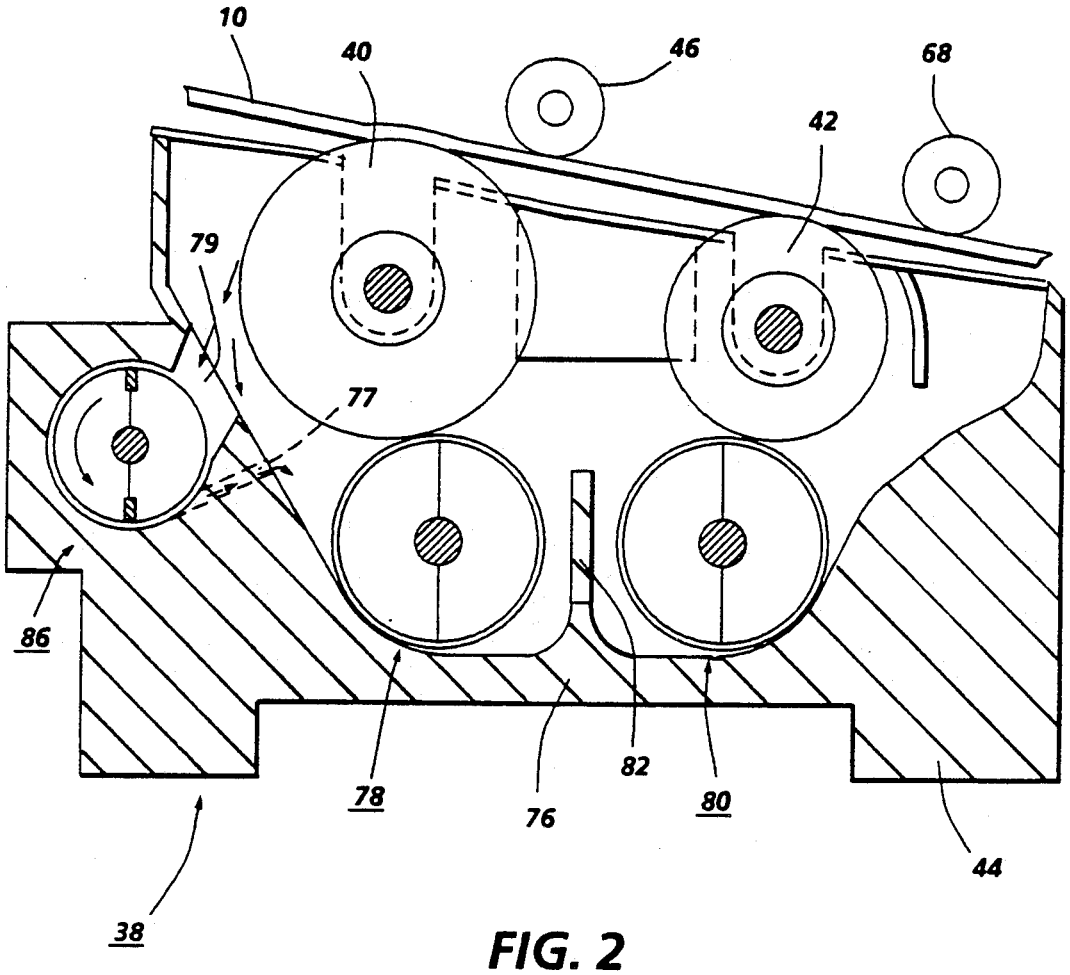
FIG. 2 is a side elevational view showing the development apparatus used in the FIG. 1 printing machine.

It is believed that the foregoing description is sufficient for purposes of the present application to illustrate the general operation of an electrophotographic printing machine incorporating the cross-mixing apparatus of the present invention therein.

referring now to FIG. 2, there is shown development system 38 in greater detail. As shown thereat, development system 38 includes a housing 44 defining a chamber 76 for storing a supply of developer material therein. Developer rollers 40 and 42 are mounted in chamber 76 of housing 44 and positioned closely adjacent to belt 10, i.e. a portion of belt 10 is wrapped about developer rollers 40 and 42. Guide rollers 46 and 68 engage the backside of belt 10 and position belt 10 so that a portion thereof wraps about a region of developer roller 46 forming an extended development zone ranging from about 5° to about 25°. Another portion of belt 10 wraps about a region of developer roller 42 forming an extended development zone ranging from about 5° to about 25°. Preferably, developer rollers 40 and 42 each include a non-magnetic tubular member made preferably from aluminum and having the exterior circumferential surface thereof roughened. An elongated magnet is positioned interiorly of and spaced from the tubular member. The magnet is mounted stationarily and generates a low magnetic field in the development zone to permit high agitation of the developer material thereat. The tubular member rotates to advance the developer material adhering thereto into the development zone where the toner particles are attracted from the carrier granules to the latent image recorded on photoconductive surface 12 of belt 10.

With continued reference to FIG. 2, augers, indicated generally by the reference numerals 78 and 80, are located in chamber 76 of housing 44. Augers 78 and 80 are substantially identical to one another. Each of the augers is mounted rotatably in chamber 76 to mix and transport developer material. Each auger has blades extending spirally outwardly from a shaft. The blades are designed to advance the developer material in the axial direction. Augers 78 and 80 rotate in opposite directions to advance the developer material in opposite directions. In this way, the developer material moves in a recirculating path. Auger 86 is mounted rotatably in an opening in the developer housing. Auger 86 has blades extending spirally outwardly from a shaft. New toner particles are discharged into the chamber of the developer housing from a toner container (not shown). These toner particles are mixed with the developer material by auger 86. In this way, the developer material is mixed and dispersed. This improves the charge characteristics of the developer material. Augers 78 and 80 are substantially equal in size. Auger 78 transports developer material to developer roller 40 and auger 80 transports developer material to developer roller 42. The centers of augers 78 and 80 lie in a common plane that is substantially parallel to the horizontal plane. A generally planar plate or baffle 82 separates auger 78 from auger 80. The developer material moves gently between augers at the respective ends thereof. Further details of augers 78 and 80 and baffle 82 are discussed with reference to FIGS. 2 and 3. Inasmuch as housing 44 and chamber 76 are level, the developer material flow in each of the augers can be balanced. In this way, the mixing of the developer material through out chamber 76 is substantially uniform and each developer roller has substantially the same quantity of developer material transported thereto. Auger 86 is smaller in diameter than augers 78 and 80. After development of the electrostatic latent image, a portion of the developer material on developer roller 40 passes through opening 79 onto auger 86 at one end thereof. The developer material is mixed as auger 86 moves the developer material in an axial and radial direction. Opening 77 is located at the other end of auger 86. Auger 86 moves the material from opening 79 to opening 77. The mixed developer material is discharged through opening 77 onto auger 78.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particle being optimized.

Figure 4:
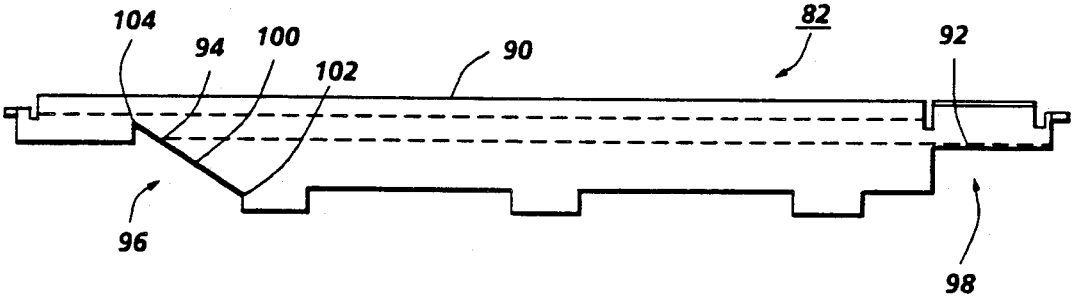
FIG. 4 is an elevational view of the baffle plate separating the augers used in the FIG. 3 mixing system.
Figure 3:
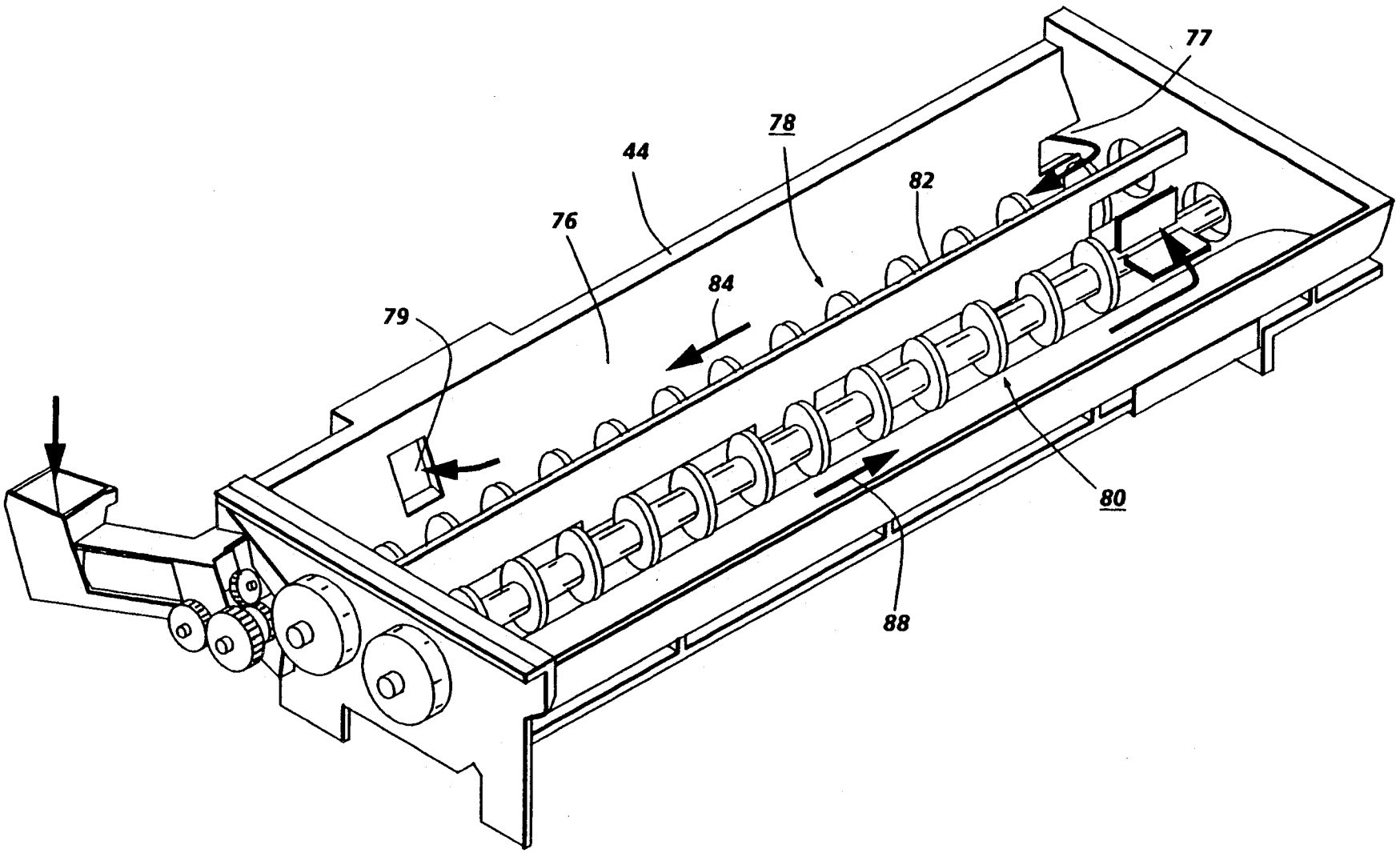
FIG. 3 is a perspective view of the mixing system used in the FIG. 2 development apparatus.

Referring now to FIGS. 3, new toner particles are furnished to auger 82 from auger 86 (FIG. 2) through opening 77. Auger 78 advances the new toner particles and developer material in the direction of arrow 84. Developer roller 40 attracts a portion of the developer material being advanced by auger 78 thereto. Baffle 82 is interposed between auger 78 and 80 so as to prevent the intermingling of developer material being advanced by auger 78 with the developer material being advanced by auger 80. This insures that the developer material moves to the end of auger 80 where an opening or aperture in baffle 82 enables the developer material to flow onto auger 80. Auger 80 advances the developer material in the direction of arrow 88. Developer roller 42 attracts a portion of the developer material being advances by auger 80 thereto. The developer material advanced by auger 80 to the end thereof moves through an opening in baffle 82 onto auger 78 for recirculation with fresh toner particles received from opening 77. Baffle 82 separates auger 78 from auger 80 over its entire length except for about 75 millimeters at opposed marginal end regions thereof. Developer material moves between augers in this regions. In the cross over region, the developer material leaves the longitudinal influence of the auger face and is directed laterally onto the other auger. In order to prevent the formation of a hump in one auger sump until the developer material spreads out sufficiently to be influenced longitudinally by the other auger, the aperture in the baffle plate at either end must be configured to reduce back up, i.e. hump formation, and flow unevenness. FIG. 4 depicts baffle plate 82 in greater detail.

As shown in FIG. 4, baffle plate 82 is a generally planar member made from sheet metal. Baffle plate 82 includes a mid-region 90 which is designed to separate auger 78 from auger 80. Marginal end region 92 has a substantially rectangular opening therein. As previously described with reference to FIG. 3, new toner particles are furnished to auger 78 from opening 77. The developer material crosses over from auger 80 to auger 78 through rectangular opening or slot 98 in end 92. The quantity of developer material crossing from auger 80 to auger 78 through opening 98 in end 92 of baffle 82 is reduced as developer material and toner particles are supplied to developer rollers 40 and 42 before reaching opening 98. A greater amount of developer material crosses from auger 78 to auger 80 through opening 96 in end 94 since only developer roller 40 has received developer material. Thus, the problem of back up causing a hump and flow unevenness is most critical in the region of end 94. Side 100 of opening or slot 96 is sloped resulting in slot 96 being tapered or triangular. The size of the opening progressively increases in a direction along the planar member toward one end thereof. Thus, the size of opening 96 increases from region 102 to region 104. Tapering opening 96 allows developer material to be gently moved from auger 78 to auger 80. This reduces the hump so that the variation of developer material thickness between developer rollers is negligible. It also enhances and provides for more precise control over the developer material being picked up and metered by the developer roller system. Furthermore, violent interaction is minimized, thereby increasing developer material life and decreasing airborne developer material and reducing contamination. It is clear that, if it is found necessary, end region 92 can use a tapered slot in lieu of the rectangular slot as well.

In recapitulation, it is evident that the cross mixing apparatus of the present invention includes a pair of augers with a baffle plate interposed therebetween to separate the developer material being advanced thereby. The baffle plate has slots at opposed marginal end regions so that the developer material can cross from one auger to the other auger. In this way the developer material moves in recirculating path. At least one of slots is tapered to allow the developer material to gently cross from one auger to the other auger. The reduces the hump so that variation of developer material on the developer rollers is negligible It is, therefore, apparent that there has been provided in accordance with the present invention, a mixing system that fully satisfies the aims and advantages hereinbefore set forth. WHile this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type in which an electrostatic latent image recorded on a photoconductive member is developed with a developer material, wherein the improvement includes, a housing defining a chamber storing a supply of developer material therein;

first means for transporting the developer material in a first direction from one region of the chamber of said housing to another region thereof;

second means for transporting the developer material in a second direction opposed to the first direction;

means, disposed, at least partially in the chamber of said housing, for developing the electrostatic latent image recorded on the photoconductive member with developer material, said developing means receiving developer material from said first means and said second means; and means for separating said first means from said second means, said separating means having an aperture in at least one portion thereof configured to allow developer material to gently move between said first means and said second means and adapted to reduce back up of developer material and flow unevenness, said separating means comprising a generally planar member having a sloped surface and being mounted in said housing between said first means and said second means to define a substantially vertical wall therebetween with said housing and the sloped surface of said planar member defining, in one marginal region, a slot progressively increasing in size in a direction along said planar member toward one end thereof.

2. A printing machine according to claim 1, wherein said slot is configured in the shape of a triangle.

3. A printing machine according to claim 2, wherein:

said first means includes a first auger adapted to rotate in a first direction; and said second means includes a second auger adapted to rotate in a second direction opposed to the first direction.

4. A printing machine according to claim 3, wherein said developing means includes:

a first developer roller positioned adjacent a portion of the photoconductive member and being adapted to receive developer material from said first means; and a second developer roller positioned adjacent another portion of the photoconductive member and being adapted to receive developer material from said second means.

* * * * *